United States Patent [19]

Le Floch

[11] 4,146,234

[45] Mar. 27, 1979

[54] PARLOR GAME WITH PIECES WHICH CAN BE MOVED ON COMPARTMENTS

[76] Inventor: Jacques N. Y. M. Le Floch, 1, rue Santeuil 44000, Nantes (Loire-Atlantique), France

[21] Appl. No.: 814,888

[22] Filed: Jul. 12, 1977

[30] Foreign Application Priority Data

Jul. 16, 1976 [FR] France ..... 76 21765

[51] Int. Cl.[2] ..... A63F 3/02

[52] U.S. Cl. ..... 273/261; 273/290

[58] Field of Search ..... 273/131 AB, 131 E, 131 F, 273/131 L, 131 KN, 131 K, 137 F, 137 AC, 260, 261, 290

[56] References Cited

U.S. PATENT DOCUMENTS

| | | | |
|---|---|---|---|
| 104,379 | 6/1870 | Vander-Weyde | 273/131 AB |
| 259,217 | 6/1882 | Sanderson | 273/137 F |
| 437,838 | 10/1890 | Sperl | 273/131 AB |
| 526,373 | 9/1894 | Boyer | 273/131 L |
| 529,582 | 11/1894 | Beaman | 273/131 F |
| 665,123 | 1/1901 | McLoughlin | 273/131 K |
| 1,056,526 | 3/1913 | Fortnam | 273/131 F |
| 1,373,448 | 4/1921 | Precinauskas | 273/131 KN |
| 1,623,881 | 4/1927 | Mayer | 273/131 KN |
| 3,810,626 | 5/1974 | Eberle | 273/131 KN |
| 3,963,242 | 6/1976 | Treugut et al. | 273/131 KN |

FOREIGN PATENT DOCUMENTS

| | | | |
|---|---|---|---|
| 3585 | 8/1919 | Netherlands | 273/131 KN |
| 16560 of | 1905 | United Kingdom | 273/137 F |
| 495994 | 11/1938 | United Kingdom | 273/131 AB |
| 620529 | 3/1949 | United Kingdom | 273/131 F |

*Primary Examiner*—Richard C. Pinkham
*Assistant Examiner*—Harry G. Strappello
*Attorney, Agent, or Firm*—Cushman, Darby & Cushman

[57] ABSTRACT

Parlor game comprising a playing surface presenting neighboring compartments each having any geometrical configuration with a closed outline, pieces which can be moved on these compartments, characterized by the fact that the compartments compose sets each comprising a central compartment and peripheral compartments surrounding the central compartment, the central compartments of the various sets being all marked with one and the same sign, the sets being arranged in relation to one another in such a way as to have in common at least one peripheral compartment when one considers two neighboring sets.

15 Claims, 6 Drawing Figures

PARLOR GAME WITH PIECES WHICH CAN BE MOVED ON COMPARTMENTS

The invention relates to a parlour game for at least two players, using a playing surface divided into neighbouring compartments on which playing pieces are moved.

Games of this type are already known, such as draughts, chess, backgammon etc.

The main purpose of the invention is to provide a game which is distinguished from the known games by various important points which greatly enlarge its possibilities and interest.

For example the games of draughts and chess can only be played by two players.

One of the aims of the invention is to provide a game which can be played by two or three or four players without the interest of the game being decreased.

Another aim of the invention is therefore to provide a parlour game in which the movements of the pieces are controlled solely by the strategic or tactical ideas of the players.

In particular, and this is one of the appreciable advantages of the game according to the invention, the playing surface is such that it allows movements of the pieces to be devised which are inspired directly from the branch of modern mathematics known as sets. The game according to the invention can therefore form a special training for children for whom it allows the concrete and direct utilisation of their knowledge.

Furthermore, the known games mentioned above are played on playing surfaces which are divided into compartments according to precise and unchangeable rules, such as the draughtboard or chessboard. For this reason the division of the surface into compartments and the rules of the games are closely associated. Thus it is practically impossible to devise, on the basis of these playing surfaces, different rules or different games which would preserve the essential features of difficulty and interest.

Another aim of the invention is to provide, on the contrary, a playing surface established in accordance with material constructional characteristics such that it can be made according to numerous variants without losing its essential characteristics.

In this way it is possible to devise numerous variants in regard to the rules of the game. These variants renew the game and widen its attraction without making it lose its interest or its training aspect.

Naturally the rules in question do not themselves form part of the invention. One will give later on an example of a possible rule, but this will be with the sole intention of making it easier to appreciate the advantages provided by the game according to the invention as compared with the classic games of the same type.

The aims mentioned above are achieved by making use of a playing surface divided into neighbouring compartments, each having any geometrical shape with a closed outline, pieces which can be moved on these compartments, in which the compartments compose sets each comprising a central compartment and peripheral compartments surrounding the central compartment, the central compartments of the various sets being all marked with the same sign, and the sets being arranged in relation to one another so as to have in common at least one peripheral compartment when one considers two neighbouring sets.

Generally speaking, the compartments of the sets are polygons selected from among the following categories of polygon: triangles, squares, hexagons, octagons, the central compartments of the sets and the peripheral compartments belonging respectively to identical or different categories, and the peripheral compartments of any set belonging to identical or different categories. In a particular embodiment, the compartments of the sets are geometrical figures with a closed outline such as circles, ellipses.

According to one embodiment of the invention, each set is composed of a central compartment and six peripheral compartments; the neighbouring compartments in pairs have a common peripheral compartment and each compartment has a geometrical design selected from a group of a number of typically dissimilar designs, the adjacent peripheral compartments having different designs.

The movable pieces are distributed in two categories having different heights and referred to respectively as low pieces and high pieces, and certain at least of these pieces are equipped with means which make it possible to lock a plurality of them together by stacking them.

Preferably the pieces of one category possess, in cross-section, a profile which has been selected to correspond with the geometrical designs shown on the compartments.

In order to make it easier to understand the invention, there will now be given a description of several embodiments of a playing surface. Reference will be made to the attached drawings in which.

The playing surfaces illustrated by FIGS. 1 to 5 show that, according to the invention, they present a multitude of the neighbouring compartments, the number of which does not have to be strictly limited as is required for draughtboards and chessboards. The compartments are geometrical figures, the nature of which is also not compulsory; it is sufficient for the figures to have at least three sides, that is to say for the compartments to be triangles (reference a in FIG. 2).

Figure 1:
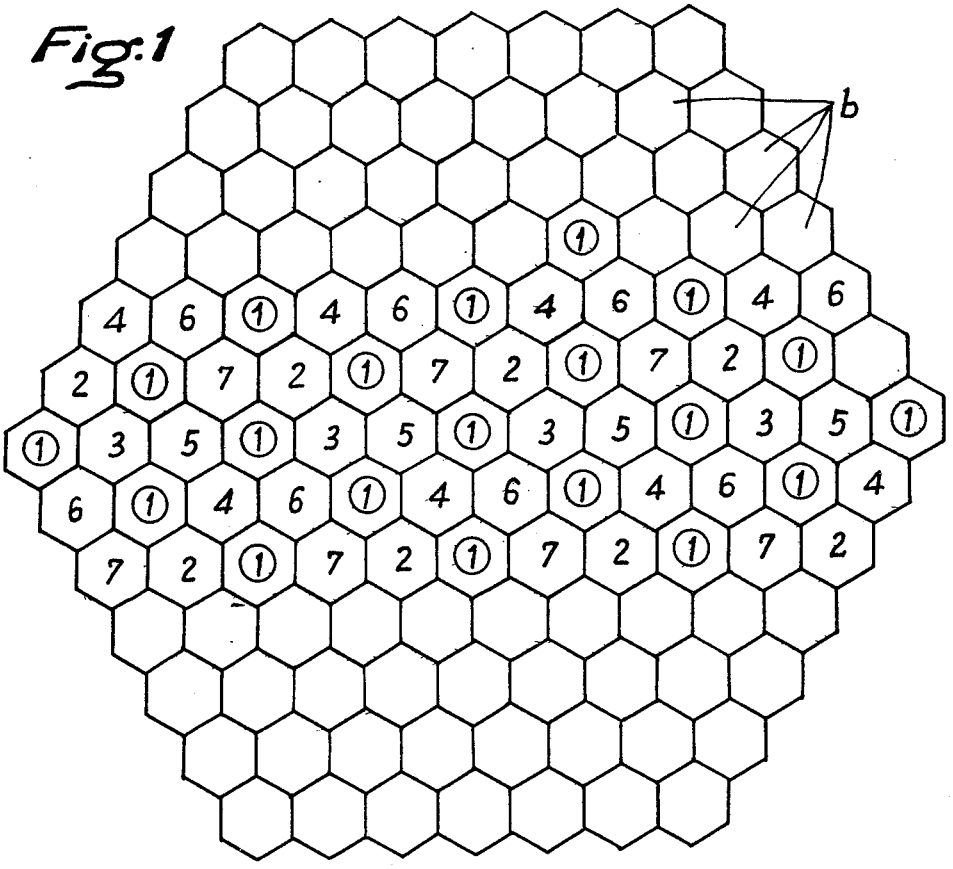
FIG. 1 is a first example of a playing surface in accordance with the invention, on the basis of hexagons.
Figure 2:
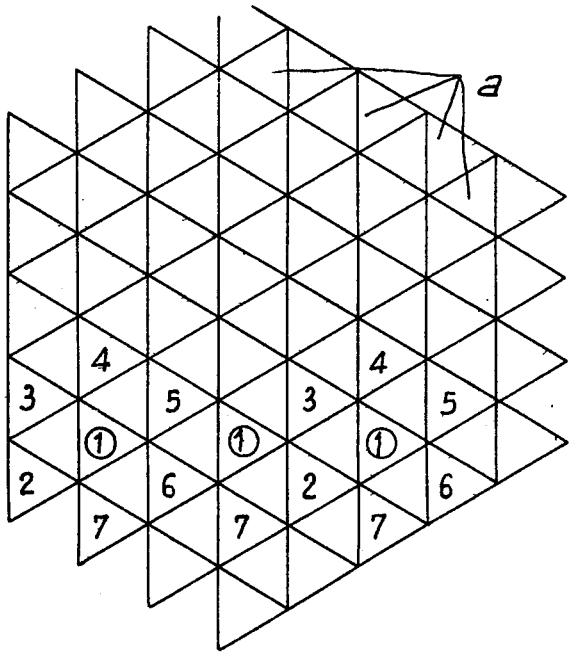
FIG. 2 is a second example of a playing surface in accordance with the invention, on the basis of triangles.
Figure 4:
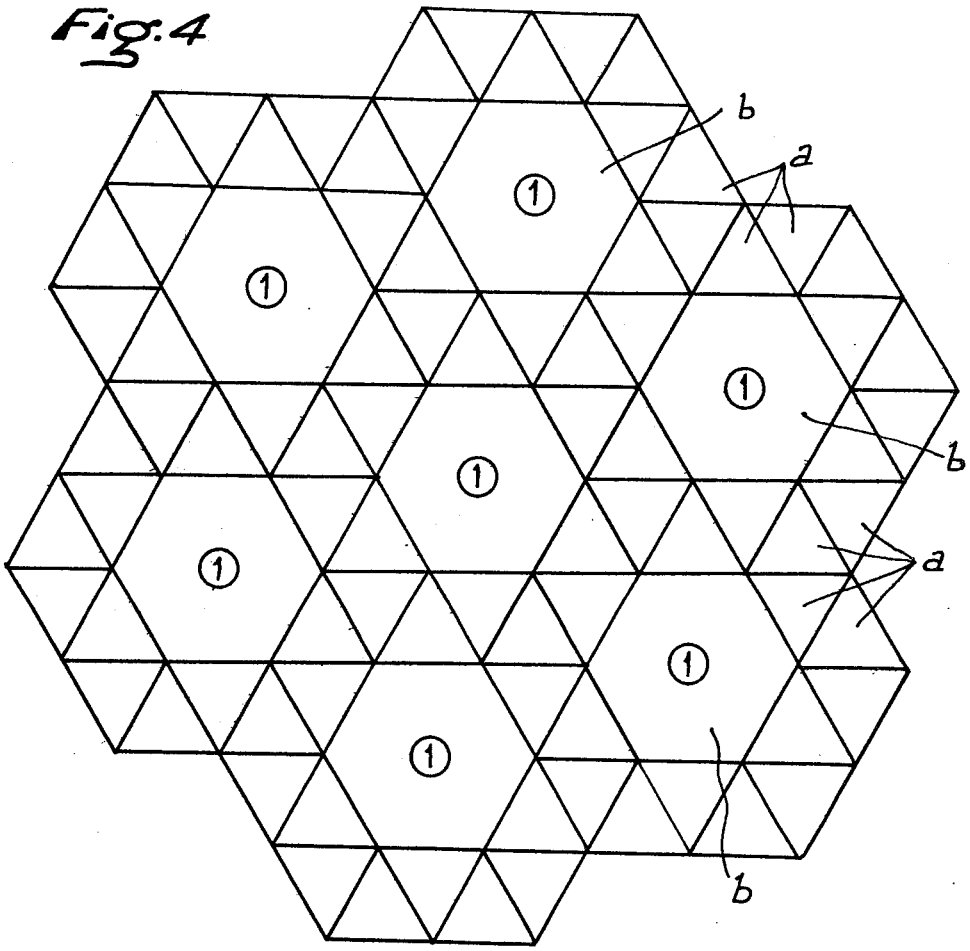
FIG. 4 is a fourth example of a playing surface in accordance with the invention on the basis of hexagons and triangles.
Figure 5:
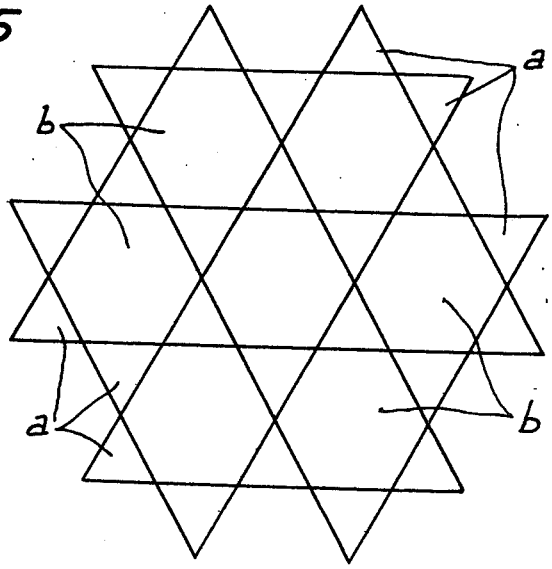
FIG. 5 is a fifth example of a playing surface in accordance with the invention on the basis of triangles and hexagons.

It is also possible with the invention to divide the playing surface into hexagonal comparts b (FIG. 1). One may also adopt at the same time both triangular compartments a and hexagonal compartments b giving them one relative arrangement or another as shown in FIGS. 4 and 5.

The invention does not have to be restricted to these examples; one may adopt both triangular compartments a, hexagonal compartments b and square compartments c. (See FIG. 3).

Whatever may be the geometrical figure or figures adopted and the exact number of compartments, according to the invention the compartments compose sets each comprising a central compartment and peripheral compartments.

Figure 3:
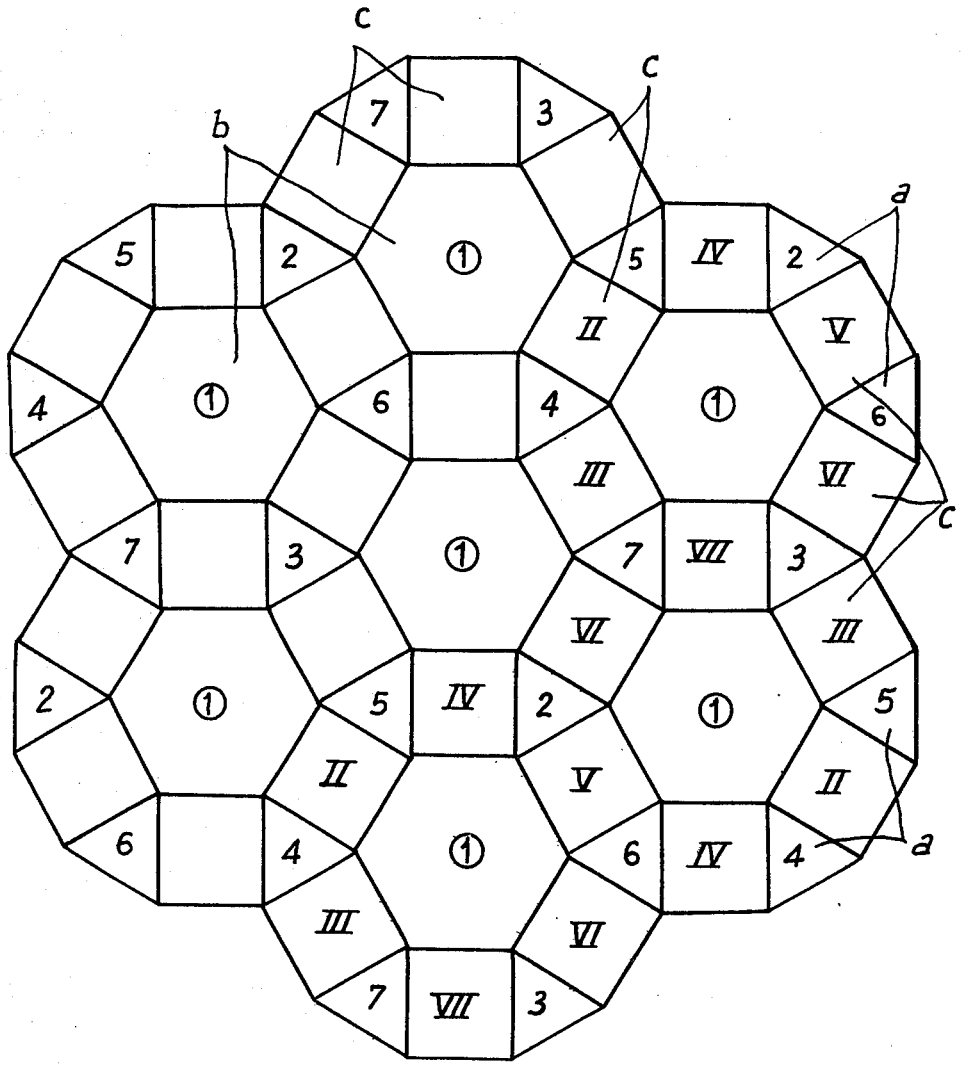
FIG. 3 is a third example of a playing surface in accordance with the invention, on the basis of hexagons, triangles and squares.

In order to show these sets, one has designated the compartments which form part thereof by the number 1 in the case of the central compartment and by the numbers 2 to 7 for the peripheral compartments in FIGS. 1, 2, 3, 6. The number of peripheral compartments is not necessarily equal to six, although this arrangement is preferred. FIG. 3 shows that the central compartment 1 of a set may be surrounded by six triangular peripheral compartments 2 to 7 and six other square peripheral compartments II to VII, for example. In other words, a compartment 1 may serve as the central compartment for a number of sets comprising a number of peripheral compartments surrounding this common central compartment.

Figure 6:
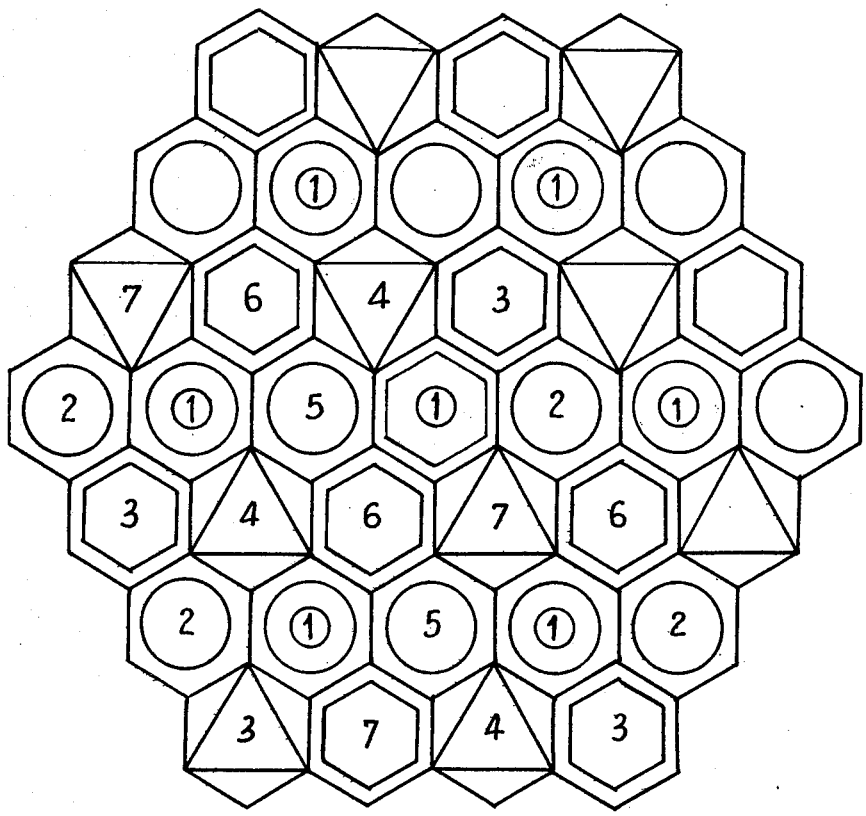
FIG. 6 is a view of the playing surface of FIG. 1 having a variant of the arrangement of the sets and with designs borne by the compartments.

Naturally, on an actual playing surface the central compartments 1 are not indicated by a number but by a colour (black for example, as in FIG. 6). Generally speaking, the peripheral compartments do not need to be marked. In the case of FIG. 3, one may draw a distinction between the peripheral compartments 2 to 7 of a set from the compartments II to VII of another set by means of colours.

One will observe that one could also consider in FIG. 3 that the sets are composed of 12 peripheral compartments surrounding a central compartment. This arrangement must be accepted as equivalent to that which has been explained above.

On the playing surface the sets overlap partly and have common peripheral compartments (at least one common compartment) as shown clearly in FIGS. 1, 3 and 6.

According to another feature of the invention one may draw on the compartments a geometrical design selected from a group of typically dissimilar designs. For the game of FIG. 6, one has chosen from a group of three designs only: for example a ring, a triangle, a hexagon.

In the case of a surface having sets possessing six peripheral compartments and overlapping, one distributes the designs on the peripheral compartments in such a way that two identical designs (two circles or two triangles) are not located on two adjacent compartments in one and the same set. The central compartments carry one of the designs, for example a hexagon (central compartment of a central set) or a ring (central compartments of the satellite sets in FIG. 6). FIG. 6 relates to a preferred example of the invention but naturally it is possible to make many variants in it, as has been explained.

The game according to the invention also comprises playing pieces.

When there are no designs on the compartments, the playing pieces may resemble ordinary pawns, according to the invention, they are all equipped with means which make it possible to hold them together when they are stacked, for example thanks to an aperture provided on one surface and to a projection provided on the other surface. Any other equivalent means may be adopted.

According to one feature of the invention, it is advantageous to give the playing pieces two different heights so as to distribute them into two categories, one called the high category and the other the low category. Thus it is possible to have two types of piece, which makes it possible to make numerous variants in the rules of the game.

When the compartments of the playing surface carry geometrical designs, as has been explained above, it is advantageous to give the pieces of one of the two categories a profile in cross-section which corresponds to the outline of the designs. In FIG. 6 itself one may see that the playing surface comprises a central set and six satellite sets having a common peripheral compartment when they are considered in pairs. There are therefore in all 37 compartments side by side. For two players, there are 22 pieces in the low category and 4 pieces in the high category. These latter pieces are placed on the central compartments of two sets situated respectively at the top and at the bottom of FIG. 6.

When the pieces are placed in position, the aim of the game is, for each player, to conquer the central set which is left free at the beginning of the game.

It is easy to understand that when the playing surface is made up as explained above, one always finds a free central set, even when one increases the number of players. It is sufficient to adapt the number of pieces to the number of players. For example, the playing surface of FIG. 6 makes it possible for 3 players to play, each having 7 pieces of the low category and 1 piece of the high category, or 4 players each having 5 pieces of the low category and 1 piece of the high category.

Each player occupies at the commencement the compartments of one set and the neighbouring compartments if necessary. This is always possible on the playing surface according to the invention. One may agree that the pieces move by jumping, a single piece only being able to jump one compartment. Two stacked pieces may jump two compartments and three stacked pieces may jump three compartments. The opponents' pieces are taken when one jumps over them. Any set occupied by a player is a refuge for his pieces. The occupation may be a majority occupation (more compartments occupied by the player than by an opponent) or total occupation (at least one compartment of the set occupied by a single player).

As regards the division of the playing surface into compartments, it has been shown that the invention allows numerous variants because of the fact that the compartments have to have at least three sides and the maximum number of sides is not restricted by the invention. Upon repeatedly and infinitely increasing the number of sides thereof a polygon approaches a circle and it must be understood that in a game according to the invention the compartments may be circles or figures close to being circles, with a closed outline, such as ellipses. These circles or ellipses must be substantially close to compose sets, which means that they may be tangential, intersecting or closely spaced. Naturally the compartments may also have four sides, that is to say square or rectangular. When they are square, the central compartment of each set is surrounded by eight peripheral compartments, which shows that the number of six peripheral compartments is not compulsory.

In all these variants, the central compartments of the sets are all marked by any identical sign, which may be a number, a colour, a design etc.

I claim:

1. In a parlour game which includes:

a playing surface means presenting a plurality of neighboring compartments each having any desired geometrical configuration with a closed outline, so that playing pieces may be moved from compartment to compartment among these neighboring compartments, the improvement wherein:

all said compartments into and from which said playing pieces may be moved are organized into a plurality of sets;

each said set comprising a central said compartment, and a like plurality of peripheral said compartments arranged around the periphery of the respective central compartment in a like pattern of individual compartments, there being correspondence, compartment for respective compartment among sets;

first sensibly apparent means on said playing surface means distinguishing all of said central compartments in a common way from all of said peripheral compartments, without regard to set; said sets being organized into an array of adjacent sets, in which each set has at least one neighboring set with which it shares at least one said peripheral compartment in common, the respective neighboring sets thereby being partially overlapped with one another;

second sensibly apparent means on said playing surface means distinguishing some of the corresponding ones of the peripheral compartments of each of the sets, in a common way, from other, non-corresponding ones of the peripheral compartments of each of the sets, as well as from still other, remaining, non-corresponding ones of the peripheral compartments of each of the sets, there thus being at least three of said common ways, including a first one for at least one compartment per set constituting said some of the corresponding ones of the peripheral compartments of each of the sets, and a second one for at least one compartment per set constituting said other peripheral compartments of each of the sets, and a third one for at least one compartment per set constituting said still other, remaining peripheral compartments of each of the sets.

2. The parlour game improvement of claim 1, wherein:

each of said compartments is of hexagonal figure; and said second sensibly apparent means provides three further ones of said common ways thereof, for a total of six, each distinguishing one peripheral compartment per set.

3. The parlour game improvement of claim 2, wherein:

each set has at least one neighboring set with which it shares two said peripheral compartments in common, the respective neighboring sets thereby being one-third overlapped with one another, considering only the respective peripheral compartments thereof.

4. The parlour game improvement of claim 1, wherein:

each of said compartments is of triangular figure; and said second sensibly apparent means provides three further ones of said common ways thereof, for a total of six, each distinguishing one peripheral compartment per set.

5. The parlour game improvement of claim 4, wherein:

each set has at least one neighboring set with which it shares two said peripheral compartments in common, the respective neighboring sets thereby being one-third overlapped with one another, considering only the respective peripheral compartments thereof.

6. The parlour game improvement of claim 1, wherein:

each of said central compartments is of hexagonal figure; and the peripheral compartments in each set are twelve in number and are, proceeding angularly of the respective central compartment, alternatingly rectangular and triangular in figure, so that six rectangularly figured and six triangularly figured peripheral compartments surround each respective central compartment.

7. The parlour game improvement of claim 6, wherein:

each set has at least one neighboring set with which it shares three said peripheral compartments in common, including one peripheral compartment of rectangular figure and two of triangular figure.

8. The parlour game improvement of claim 6, wherein:

said second sensibly apparent means provides at least three further ones of said common ways thereof, for a total of at least six, each distinguishing at least one peripheral compartment per set.

9. The parlour game improvement of claim 6, wherein:

said second sensibly apparent means provides nine further ones of said common ways thereof, for a total of twelve, each distinguishing one peripheral compartment per set.

10. The parlour game improvement of claim 1, wherein:

each of said central compartments is of hexagonal figure;

the peripheral compartments in each set are of triangular figure and eighteen in number; and each set has at least one neighboring set with which it shares four said peripheral compartments in common.

11. The parlour game improvement of claim 1, wherein:

each of said central compartments is of hexagonal figure;

the peripheral compartments in each set are of triangular figure and six in number; and each set has at least one neighboring set with which it shares two said peripheral compartments in common.

12. The parlour game improvement of claim 1, wherein:

each of said compartments is of hexagonal figure; and said second sensibly apparent means provides a total of three differing ones of said common ways, each distinguishing two peripheral compartments per set.

13. The parlour game improvement of claim 12, wherein:

the respective corresponding twos of the peripheral compartments of each set, these being the ones which are distinguished by the same respective common way, are diametrically opposed with regard to the central compartment of the respective same set.

14. The parlour game improvement of claim 12, wherein:

each set has at least one neighboring set with which it shares two said peripheral compartments in common, the respective neighboring sets thereby being one-third overlapped with one another, considering only the respective peripheral compartments thereof.

15. In a parlour game which includes:

a playing surface means presenting a plurality of neighboring compartments each having any desired geometrical configuration with a closed outline, so that playing pieces may be moved from compartment to compartment among these neighboring compartments, and which is to be used with playing pieces having three mutually different geometrical figures in plan, the improvement wherein:

all said compartments into and from which said playing pieces may be moved are organized into a plurality of sets;

each said set comprising a central said compartment, and a like plurality of peripheral said compartments arranged around the periphery of the respective central compartment in a like pattern of individual compartments, there being correspondence, compartment for respective compartment among sets;

first sensibly apparent means on said playing surface means distinguishing all of said central compartments in a common way from all of said peripheral compartments, without regard to set;

said sets being organized into an array of adjacent sets, in which each set has at least one neighboring set with which it shares at least one said peripheral compartment in common, the respective neighboring sets thereby being partially overlapped with one another;

second sensibly apparent means on said playing surface means distinguishing some of the corresponding ones of the peripheral compartments of each of the sets, in a common way, from other, non-corresponding ones of the peripheral compartments of each of the sets, as well as from still other, remaining, non-corresponding ones of the peripheral compartments of each of the sets, there thus being at least three of said common ways, including a first one for at least one compartment per set constituting said some of the corresponding ones of the peripheral compartments of each of the sets, and a second one for at least one compartment per set constituting said other peripheral compartments of each of the sets, and a third one for at least one compartment per set constituting said still other, remaining peripheral compartments of each of the sets;

each of said compartments being of hexagonal figure;

said second sensibly apparent means providing a total of three differing ones of said common ways, each distinguishing two peripheral compartments per set;

the respective corresponding twos of the peripheral compartments of each set, these being the ones which are distinguished by the same respective common way, being diametrically opposed with regard to the central compartment of the respective same set;

each set having at least one neighboring set with which it shares two said peripheral compartments in common, the respective neighboring sets thereby being one-third overlapped with one another, considering only the respective peripheral compartments thereof;

each of said three common ways of said second sensibly apparent means being constituted by a marking upon each respective peripheral compartment of a respective one of said three mutually different geometrical figures.

* * * * *